US011622598B2

(12) United States Patent
Bar

(10) Patent No.: US 11,622,598 B2
(45) Date of Patent: Apr. 11, 2023

(54) EASY-ENTRY SHOE WITH A SPRING-FLEXIBLE REAR

(71) Applicant: Orthofeet, Inc., Norwood, NJ (US)

(72) Inventor: Aharon Bar, Fort Lee, NJ (US)

(73) Assignee: Orthofeet, Inc., Norwood, NJ (US)

( * ) Notice: Subject to any disclaimer, the term of this patent is extended or adjusted under 35 U.S.C. 154(b) by 0 days.

(21) Appl. No.: 17/488,032

(22) Filed: Sep. 28, 2021

(65) Prior Publication Data

US 2023/0052916 A1 Feb. 16, 2023

Related U.S. Application Data

(60) Provisional application No. 63/233,451, filed on Aug. 16, 2021.

(51) Int. Cl.

| | |
|---|---|
| ***A43B 13/28*** | (2006.01) |
| ***A43B 11/00*** | (2006.01) |
| ***A43B 23/02*** | (2006.01) |
| ***A43B 1/00*** | (2006.01) |

(52) U.S. Cl.
CPC ..... *A43B 11/00* (2013.01); *A43B 1/0018* (2013.01); *A43B 23/028* (2013.01)

(58) Field of Classification Search
CPC ..... A43B 11/00
See application file for complete search history.

(56) References Cited

U.S. PATENT DOCUMENTS

| | | | | |
|---|---|---|---|---|
| 1,464,342 A | | 8/1923 | Rothacher | |
| 1,686,175 A | | 10/1928 | Read | |
| 2,069,752 A | | 2/1937 | Dorr | |
| 2,693,039 A | | 11/1954 | Balut | |
| 2,736,110 A | | 2/1956 | Imon | |
| 2,920,402 A | | 1/1960 | Minera | |
| 3,336,683 A | | 8/1967 | Schellkopf | |
| 3,886,674 A | * | 6/1975 | Pavia | A43B 21/30 36/38 |
| 4,489,509 A | * | 12/1984 | Libit | A43B 3/18 36/7.1 R |
| 4,592,153 A | * | 6/1986 | Jacinto | A43B 1/0054 36/38 |
| 4,608,769 A | | 9/1986 | Sturlaugson | |
| 5,054,216 A | * | 10/1991 | Lin | A43B 3/00 36/138 |
| 5,279,051 A | * | 1/1994 | Whatley | A43B 13/181 36/114 |

(Continued)

FOREIGN PATENT DOCUMENTS

WO 2012077899 A2 6/2012

*Primary Examiner* — Jila M Mohandesi
(74) *Attorney, Agent, or Firm* — Smith Tempel Blaha LLC; Gregory Scott Smith

(57) ABSTRACT

A shoe including a sole and a shoe upper, the shoe upper including a shoe opening for entering the shoe, the shoe opening defined by a rear part, a medial part, a lateral part, and a front part, the rear part including a top portion, reinforced by a firm material, an optional bottom portion reinforced by a firm material, a center portion, located between the top portion and the bottom portion, the center portion made of a flexible material, and a spring element. The top part of the spring element being attached to the top portion of the rear part, and the bottom part of the spring element being attached to either the bottom portion of the rear part, or to the sole.

5 Claims, 6 Drawing Sheets

(56) References Cited

U.S. PATENT DOCUMENTS 6,557,271 B1 * 5/2003 Weaver, III ..... A43B 21/26 36/35 B
6,792,823 B2 * 9/2004 Takahashi ..... B41J 3/4075 74/413
6,877,252 B2 4/2005 Wilkinson
7,219,447 B2 * 5/2007 LeVert ..... A43B 7/1425 36/27
7,331,122 B2 2/2008 Januszewski et al.
7,439,837 B2 10/2008 McDonald
7,685,747 B1 * 3/2010 Gasparovic ..... A43B 11/00 36/102
7,793,438 B1 * 9/2010 Busse ..... A43B 11/02 36/105
D637,380 S * 5/2011 Niedner ..... A43B 13/181 D2/964
7,980,010 B2 7/2011 Davis et al.
D690,192 S * 9/2013 Takakuwa ..... F16F 1/328 D8/396
8,769,845 B2 7/2014 Lin
9,119,436 B1 9/2015 Ardell et al.
9,144,262 B2 9/2015 Ardell et al.
9,265,305 B2 2/2016 Hatfield et al.
9,364,044 B2 * 6/2016 Goldston ..... A43B 13/185
9,402,435 B2 8/2016 Baker et al.
9,429,179 B2 * 8/2016 Tran ..... F16F 1/328
9,456,652 B2 10/2016 Davis et al.
9,675,132 B2 6/2017 Marshall
9,820,527 B2 11/2017 Pratt et al.
9,839,261 B2 12/2017 Hatfield et al.
9,877,542 B2 1/2018 Pratt
10,098,776 B2 10/2018 Zaccaria
10,159,304 B2 12/2018 Farage
10,306,947 B2 6/2019 Pratt et al.
10,455,898 B1 10/2019 Orand et al.
10,506,842 B2 12/2019 Pratt et al.
10,555,578 B2 2/2020 Pratt
10,568,382 B2 2/2020 Hatfield et al.
10,568,385 B2 * 2/2020 Beers ..... A43B 11/00
10,617,174 B1 4/2020 Hopkins et al.
10,638,810 B1 5/2020 Cheney et al.
10,653,209 B2 5/2020 Pratt et al.
10,660,401 B1 5/2020 Pratt et al.
10,721,994 B2 7/2020 Kilgore
10,743,616 B2 * 8/2020 Beers ..... A43B 11/00
10,758,010 B2 9/2020 Drake
10,765,175 B2 9/2020 Panian et al.
10,813,405 B2 10/2020 Pratt
10,842,222 B2 11/2020 Zahabian
10,905,192 B1 2/2021 Cheney
10,973,279 B2 4/2021 Cheney et al.
11,064,761 B2 7/2021 Cheney
11,134,746 B2 10/2021 Seid
11,213,098 B2 * 1/2022 Beers ..... A43B 3/0063
11,497,273 B2 * 11/2022 Adametz ..... A43B 13/186
2007/0074425 A1 4/2007 Leong
2011/0016751 A1 1/2011 Somerville
2011/0185592 A1 * 8/2011 Nishiwaki ..... A43B 23/17 36/69
2012/0317839 A1 * 12/2012 Pratt ..... A43B 11/00 36/105
2018/0110292 A1 * 4/2018 Beers ..... A43B 23/088
2020/0015544 A1 1/2020 Pratt
2020/0196703 A1 * 6/2020 Hopkins ..... A43B 23/047
2021/0106094 A1 4/2021 Cheney
2021/0204645 A1 7/2021 Pratt

* cited by examiner

EASY-ENTRY SHOE WITH A SPRING-FLEXIBLE REAR

CROSS-REFERENCE TO RELATED APPLICATIONS

This is a utility application being filed in the United States as a non-provisional application for patent under Title 35 U.S.C. § 100 et seq. and 37 C.F.R. § 1.53(b) and, claiming the benefit of the prior filing date under Title 35, U.S.C. § 119(e) of the United States provisional application for patent that was filed on Aug. 16, 2021 and assigned Ser. No. 63/233,451, which application is incorporated herein by reference in its entirety.

FIELD

The field of the present disclosure and the related embodiments relate to the field of footwear, and, more particularly but not exclusively, to footwear, such as a shoe, enabling easy entry of a foot into the shoe.

BACKGROUND

A significant number of users have difficulties bending down to help put on shoes with closed heel design. However, when putting shoes on and taking them off, most shoes require bending down to lace or unlace the shoe, or help adjusting the rear part of the shoe to enter slip-on shoes. There is thus a widely recognized need for a shoe that enables a user to put it on and take it off without the need for bending down and employing the use of the user's hands.

Many such easy-entry shoe are disclosed, such as disclosed in U.S. Pat. Nos. 1,686,175, 9,675,132, 9,820,527, 9,877,542, 10,306,947, 10,506,842, 10,555,578, 10,638,810, 10,653,209, 10,660,401, 10,813,405, 10,842,222, 10,905,192, 10,973,279, and US application US20210106094, as well as PCT application WO2012077899. These solutions involve compression of the rear side of the shoe to enable the foot to enter the shoe, and a spring element that returns the compressed rear side to upright position. However, these constructions are costly to manufacture and uncomfortable to wear because of the rigid structure around the heel. Therefore, there is a need for a shoe with a more simplified construction that is easier and inexpensive to produce.

SUMMARY

According to one exemplary embodiment there is provided an article of wear such as a shoe including a sole and a shoe upper, the shoe upper including a shoe opening for entering the shoe, the shoe opening defined by a rear part, a medial part, a lateral part, and a front part, the rear part including a top portion, reinforced by a firm material, a bottom portion. reinforced by a firm material, a center portion, located between the top portion and the bottom portion, the center portion made of a flexible material, and a spring element. The top part of the spring element being attached to the top portion of the rear part, and the bottom part of the spring element being attached to the bottom portion of the rear part.

According to another exemplary embodiment there is provided an article of wear such as a shoe including shoe including a sole and a shoe upper, the shoe upper including a shoe opening for entering the shoe, the shoe opening defined by a rear part, a medial part, a lateral part, and a front part, the rear part including a top portion, reinforced by a firm material, a flexible material, located between the top portion and the sole, and a compression spring element. The top part of the compression spring element being attached to the top portion of the rear part, and the bottom part of the compression spring element being attached to the sole.

According to still another exemplary embodiment there is provided an article of wear such as a shoe where the spring element is made of a circular compression spring.

According to yet another exemplary embodiment there is provided an article of wear such as a shoe where the spring element is made of a garter compression spring.

Further according to another exemplary embodiment there is provided an article of wear such as a shoe where the spring element is made of a sinusoidal compression spring.

Still further according to another exemplary embodiment there is provided an article of wear such as a shoe where at least one of the medial part and the lateral part of the shoe includes an elastic element.

Yet further according to another exemplary embodiment there is provided an article of wear such as a shoe where the spring element is mounted vertically, at the horizontal middle of the rear part of the shoe.

Even further, according to another exemplary embodiment there is provided an article of wear such as a shoe where the spring element is curved vertically, upwards and forward, according to vertical curvature of the rear part of the shoe; and/or curved horizontally according to horizontal curvature of the rear part of the shoe.

Additionally, according to another exemplary embodiment there is provided a method for entering a shoe, including the steps of providing a shoe including a sole and a shoe upper, the shoe upper including a shoe opening for entering the shoe, the shoe opening defined by a rear part, a medial part, a lateral part, and a front part, Where the rear part of the shoe includes a top portion reinforced by a firm material, a bottom portion reinforced by a firm material, a center portion between the top portion and the bottom portion, the center portion made of a flexible material, and a compression spring element. Where the top part of the compression spring element is attached to the top portion of the rear part, and the bottom part of the compression spring element is attached to the bottom portion of the rear part. Exerting a downward force on the top portion of the rear part when a foot enters the shoe to push down the top portion of the rear part, and creating enough space for the foot to enter the shoe. And releasing the downward force on the top portion of the rear part to enable the compression spring element to push the top portion of the rear part up for securing the foot in the shoe.

According to still another exemplary embodiment there is provided a method for entering a shoe, including the steps of providing a shoe including a sole and a shoe upper, the shoe upper including a shoe opening for entering the shoe, the shoe opening defined by a rear part, a medial part, a lateral part, and a front part, Where the rear part of the shoe includes a top portion reinforced by a firm material, a center portion between the top portion and the bottom portion, the center portion made of a flexible material, and a compression spring element. Where the top part of the compression spring element is attached to the top portion of the rear part, and the bottom part of the compression spring element is attached to the sole of the shoe. Exerting a downward force on the top portion of the rear part when a foot enters the shoe to push down the top portion of the rear part and creating enough space for the foot to enter the shoe. And releasing the downward force on the top portion of the rear part to enable the compression spring element to push the top portion of the rear part up for securing the foot in the shoe.

Unless otherwise defined, all technical and scientific terms used herein have the same meaning as commonly understood by one of ordinary skill in the relevant art. The materials, methods, and examples provided herein are illustrative only and not intended to be limiting. Except to the extent necessary or inherent in the processes themselves, no particular order to steps or stages of methods and processes described in this disclosure, including the figures, is intended or implied. In many cases the order of process steps may vary without changing the purpose or effect of the methods described.

Implementation of the method and system of embodiments disclosed blow involves performing or completing certain selected tasks or steps manually, automatically, or any combination thereof. Moreover, according to actual instrumentation and equipment of preferred embodiments of the method and system presented herein several selected steps could be implemented by hardware or by software on any operating system of any firmware or any combination thereof. For example, as hardware, selected steps could be implemented as a chip or a circuit. As software, selected steps could be implemented as a plurality of software instructions being executed by a computer using any suitable operating system. In any case, selected steps of the method and system disclosed herein could be described as being performed by a data processor, such as a computing platform for executing a plurality of instructions.

BRIEF DESCRIPTION OF THE DRAWINGS

Various embodiments are described herein, by way of example only, with reference to the accompanying drawings. With specific reference now to the drawings in detail, it is stressed that the particulars shown are by way of example and for purposes of illustrative discussion of the preferred embodiments only, and are presented in order to provide what is believed to be the most useful and readily understood description of the principles and conceptual aspects of the embodiment. In this regard, no attempt is made to show structural details of the embodiments in more detail than is necessary for a fundamental understanding of the subject matter, the description taken with the drawings making apparent to those skilled in the art how the several forms and structures may be embodied in practice.

In the drawings.

DESCRIPTION OF EMBODIMENTS

Figure 1:
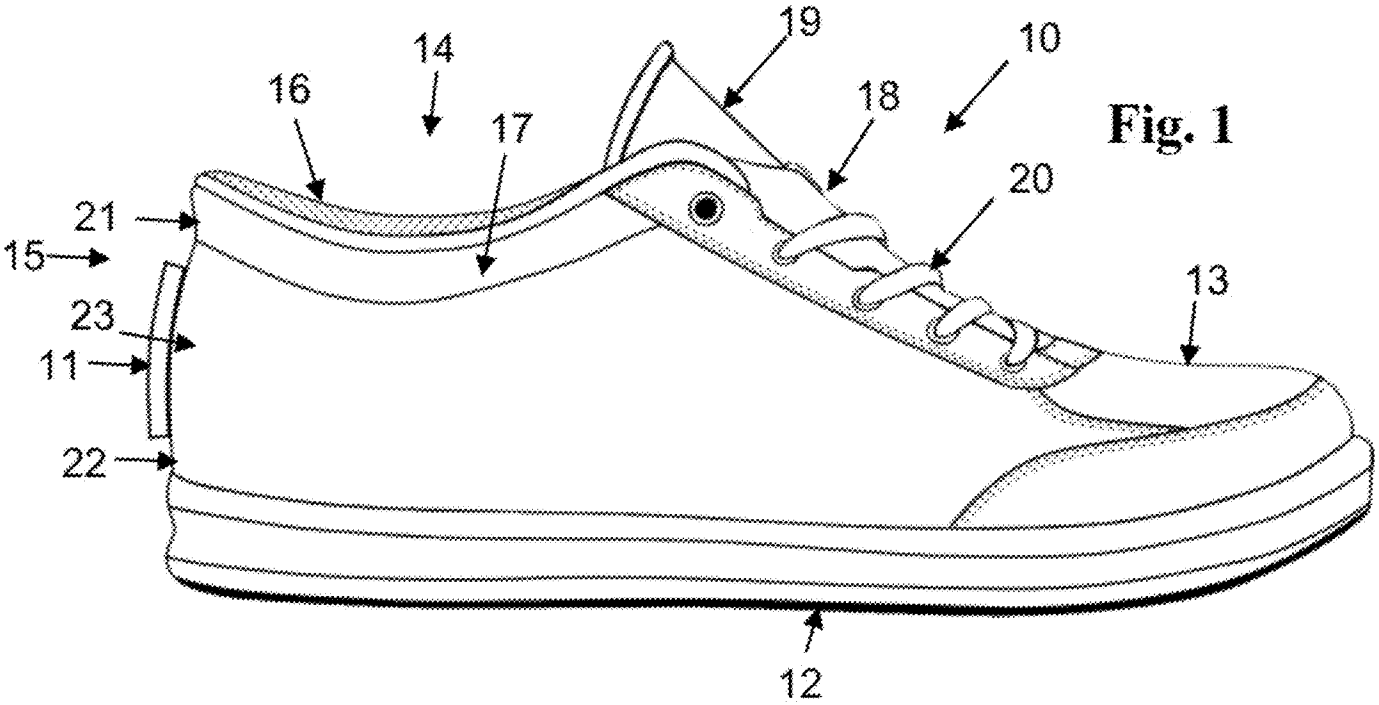
FIG. 1 is a simplified illustration of a side view of an easy entry footwear with a rear spring.

The principles and structure according to some embodiments of a footwear, such as a laced shoe or a slip-on shoe, providing easy entry of the user's foot, may be better understood with reference to the drawings and accompanying description.

Before explaining at least one embodiment in detail, it is to be understood that the embodiments are not limited in their application to the details of construction and the arrangement of the components set forth in the following description or illustrated in the drawings. Other embodiments may be practiced or carried out in various ways. Also, it is to be understood that the phraseology and terminology employed herein is for the purpose of description and should not be regarded as limiting.

In this document, an element of a drawing that is not described within the scope of the drawing and is labeled with a numeral that has been described in a previous drawing has the same use and description as in the previous drawings. Similarly, an element that is identified in the text by a numeral that does not appear in the drawing described by the text, has the same use and description as in the previous drawings where it was described.

The drawings in this document may not be to any scale. Different drawings may use different scales and different scales can be used even within the same drawing, for example different scales for different views of the same object or different scales for the two adjacent objects.

The terms 'a' or "an", as used herein, are defined as one or more than one. The term plurality, as used herein, is defined as two or more than two. The term another, as used herein, is defined as at least a second or more. The terms including and/or having, as used herein, are defined as comprising.

The term coupled, as used herein, is defined as connected, although not necessarily directly, and not necessarily mechanically.

The term 'flexible' or 'elastic' may refer to a material of a part of a shoe that may be stretched and/or compressed and/or folded by exerting a force, and may assume the original shape when the force is removed (elastic) and can be forced to the original shape. The term 'firm' or 'rigid' may refer to a material of a part of a shoe that is not 'flexible' or 'elastic' and may thus retain its shape under the force that stretches and/or compresses the 'flexible' or 'elastic' material or part of the shoe.

Reference is now made to FIG. 1, which is a simplified illustration of a side view of an easy-entry footwear 10 with a rear spring 11, according to one embodiment.

Footwear, or shoe, 10 of FIG. 1 is a right-shoe adapted for a right foot of a human user (not shown in FIG. 1). A left shoe adapted for a left foot of a human user may be similar to footwear, or a shoe, 10 of FIG. 1.

Footwear, or shoe 10 may include a sole 12 and an upper 13. The upper 13 may have a shoe opening 14 for receiving a foot of a user into the shoe 10. The shoe opening 14 may be defined by a rear part 15, a medial part 16, a lateral part 17 and a front part 18. Footwear, or shoe 10 may also include a tongue part 19 and a lacing system 20. Various types of tongue part 19, lacing system 20 and other closure systems are contemplated, including but not limited to closed shoes with elastic or stretchable material, VELCRO or hook and loop type connectors, zippers, snaps, buckles, as well as other types of closure systems.

Rear part 15 may include a top part 21, a bottom part 22, and a center part 23 located between top part 21 and bottom part 22. Top part 21 and bottom part 22 may be made of a firm and/or rigid material, that may not bend forward under the force exerted by a foot while it is being entered into the shoe 10 and while pressing down top part 21. Center part 23 may be made from an elastic and/or flexible material that may be compressed under the force exerted by a foot while it is being entered into the shoe 10.

Figure 2B:
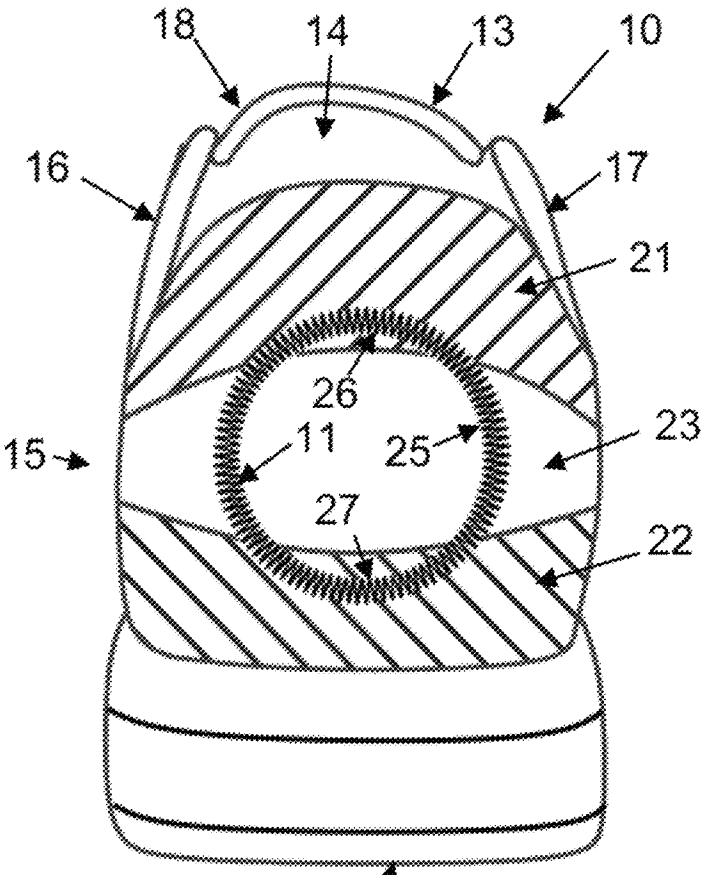
FIG. 2B is a simplified illustration of a rear view of the interior of rear part of an easy entry footwear with a garter rear spring.
Figure 2A:
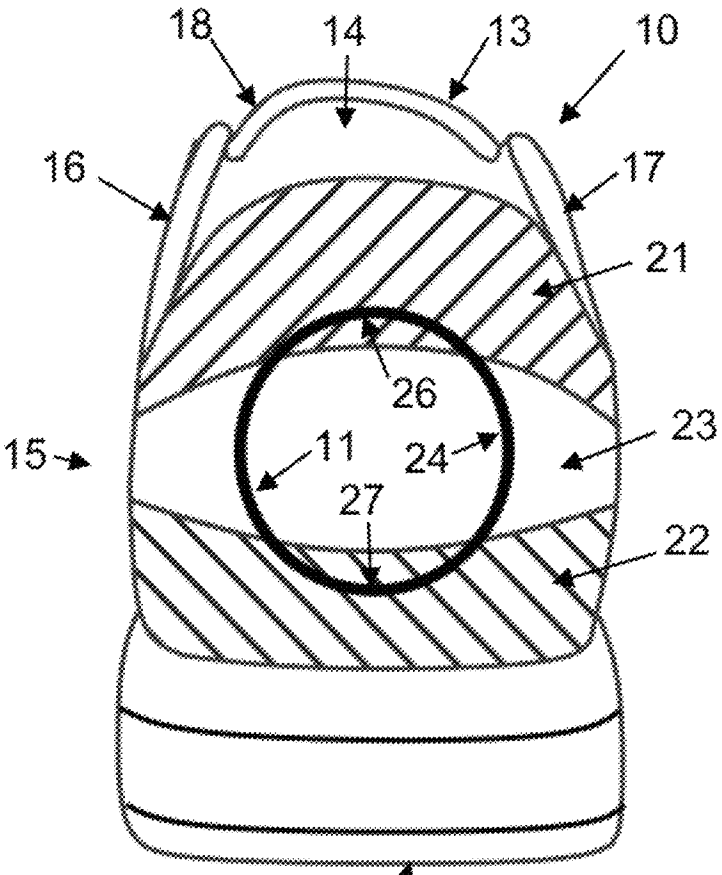
FIG. 2A is a simplified illustration of a rear view of the interior of rear part of an easy entry footwear with a circular rear spring.

Reference is now made to FIG. 2A, which is a simplified illustration of a rear view of the interior of rear part 15 with a circular spring 24, according to one embodiment, and to FIG. 2B, which is a simplified illustration of a rear view of the interior of rear part 15 with a garter spring 25, according to one embodiment.

As an option, the illustrations of FIG. 2A and FIG. 2B may be viewed in the context of the details of the previous figures. Of course, however, the illustrations of FIG. 2A and FIG. 2B may be viewed in the context of any desired environment. Further, the aforementioned definitions may equally apply to the description below.

According to one embodiment, rear spring 11 may be a compression spring mounted between top part 21 and bottom part 22. Alternatively, rear spring 11, or compression spring 11 may be mounted between top part 21 and sole 12. Rear spring 11 may be coupled on one of its ends to top part 21, and to bottom part 22 on its other end. Rear spring 11 may be mounted over (on the outside of) center part 23, or within center part 23. Rear spring 11, or compression spring 11, may be a single spring element of any shape and form and may be made to conform to the shape of rear part 15 of shoe 10. Rear spring 11, or compression spring 11, may be mounted at about the horizontal middle of rear part 15, at the very rear end of shoe 10. Rear spring 11, or compression spring 11, may be the only spring element coupling between top part 21 and bottom part 22 or sole 12.

When a foot is entered into the shoe 10 and presses down the top part 21, top part 21 may move down with respect to or towards bottom part 22, thus compressing rear spring 11.

When the foot is fully entered and resting inside the shoe 10, the foot no longer applies downward force on top part 21. As such, rear spring 11 is allowed to push top part 21 back up to its original position.

It is appreciated that the location of rear spring 11, and the shape of rear spring 11, are adapted to have a minimal effect on the flexibility of opening 14. Thus, the location of rear spring 11, and the shape of rear spring 11, allow opening 14 to adapt to the shape of the particular foot when the foot rests in shoe 10. In this respect, opening 14 may refer to the upper edges of rear part 15, medial part 16, lateral part 17, and front part 18.

As shown in FIG. 2A, circular spring 24, which is a rear spring 11 is shaped as a ring, however, other forms of spring 11 are contemplated, such as a horizontal or a vertical ellipse, egg, or an oval form. For example, FIG. 2B shows shoe 10 with rear spring 11 in the form of circular garter spring 25. Garter 25 spring may comprise a coiled spring made of carbon steel, stainless steel or any other material, which is connected at each end to create a circular shape.

As shown in FIGS. 2A and 2B, circular spring 24, and/or garter spring 25, may be coupled by its top portion 26 to top part 21, and by its bottom portion 27 to bottom part 22. Alternatively, circular spring 24 may be coupled by its top portion 26 to top part 21, and by its bottom part 27 to sole 12.

Figure 3B:
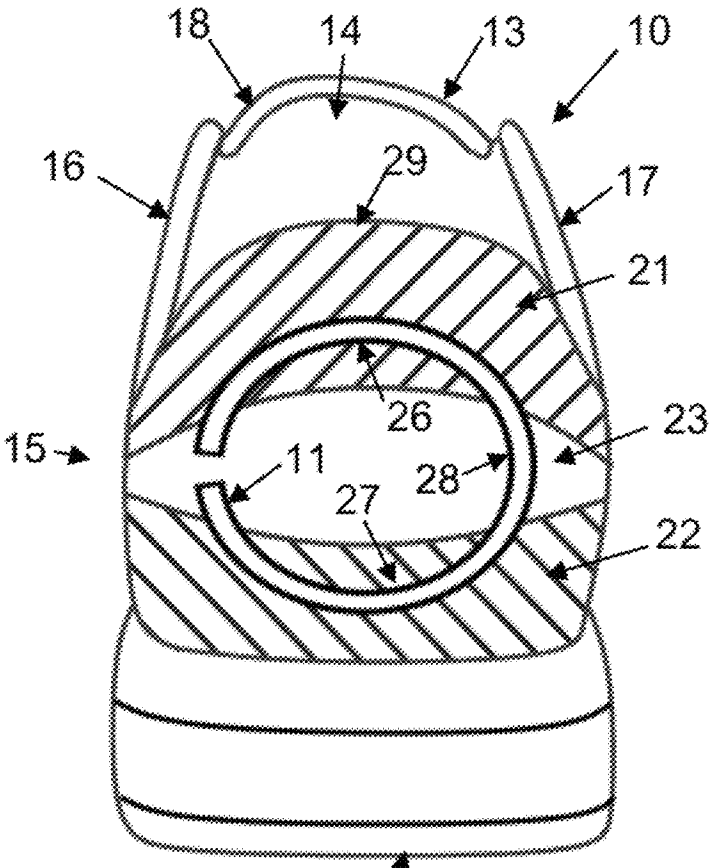
FIG. 3B is a simplified illustrations of a rear view of the interior of rear part of the easy entry footwear, with rear spring of an open circular shape with its two edges not connected to each other, and in compressed mode.
Figure 3A:
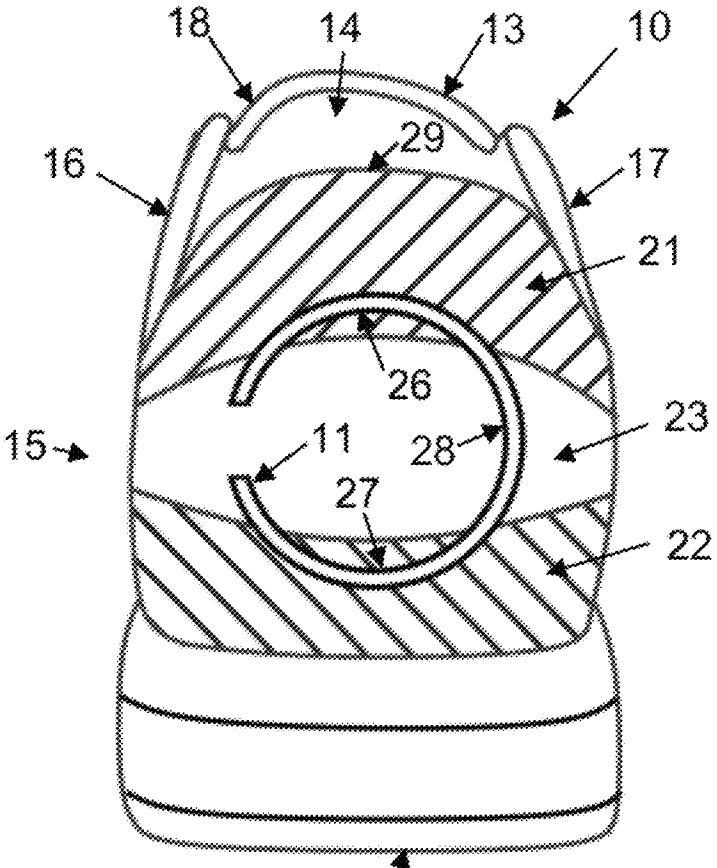
FIG. 3A is a simplified illustrations of a rear view of the interior of rear part of the easy entry footwear, with rear spring of an open circular shape with its two edges not connected to each other, and in uncompressed mode.

Reference is now made to FIG. 3A and FIG. 3B, which are simplified illustrations of a rear view of the interior of rear part 15 of shoe 10 with circular spring 28 where its two edges are not connected, according to one embodiment. FIG. 3A depicts rear part 15 and spring 28 in uncompressed mode, and FIG. 3B depicts rear part 15 and spring 28 in a compressed mode.

As an option, the illustrations of FIG. 3A and FIG. 3B may be viewed in the context of the details of the previous Figures. Of course, however, the illustrations of FIG. 3A and FIG. 3B may be viewed in the context of any desired environment. Further, the aforementioned definitions may equally apply to the description below.

As shown in FIGS. 3A and 3B spring 28 is another example of rear spring 11 and/or circular spring 24 with a shape of a partial circle, wherein its two edges are not connected. Spring 28 may be coupled by its top portion 26 to top part 21, and by its bottom portion 27 to bottom part 22. Alternatively, spring 28 may be coupled by spring top portion 26 to top part 21, and by its bottom portion 27 to sole 12.

As shown in FIG. 3B, top edge 29 of rear part 15 is lower than top edge 29 of rear part 15 in FIG. 3A, thus when top part 21 is depressed it offers more space for a foot to enter the shoe from the rear side of the shoe.

Figure 4B:
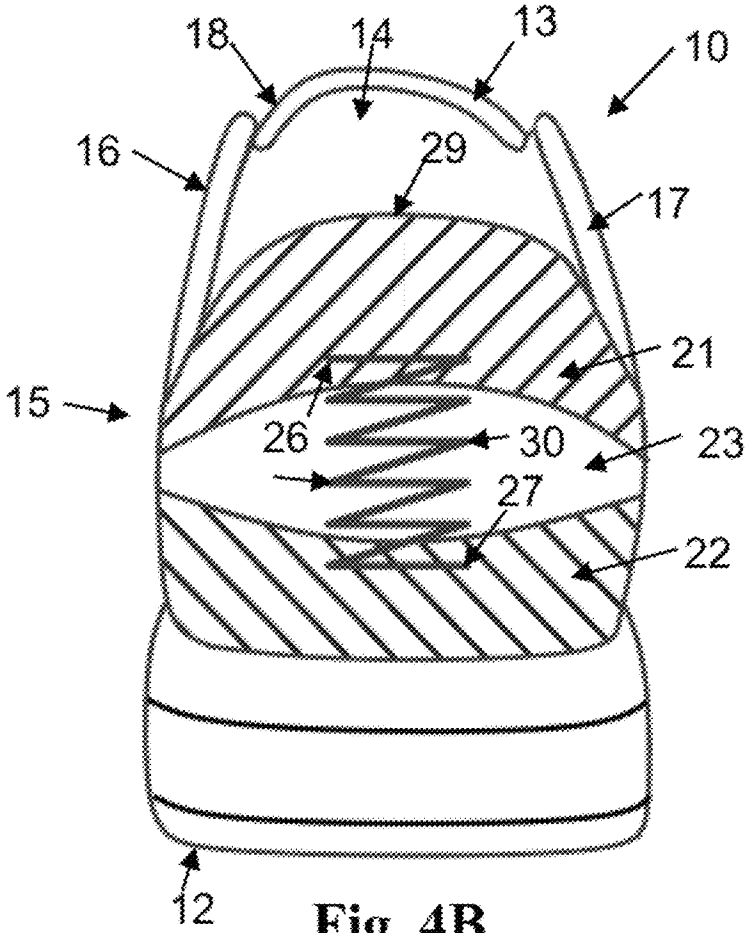
FIG. 4B is a simplified illustrations of a rear view of the interior of rear part of the easy entry footwear, with a sinusoidal compression spring, in compressed mode.
Figure 4A:
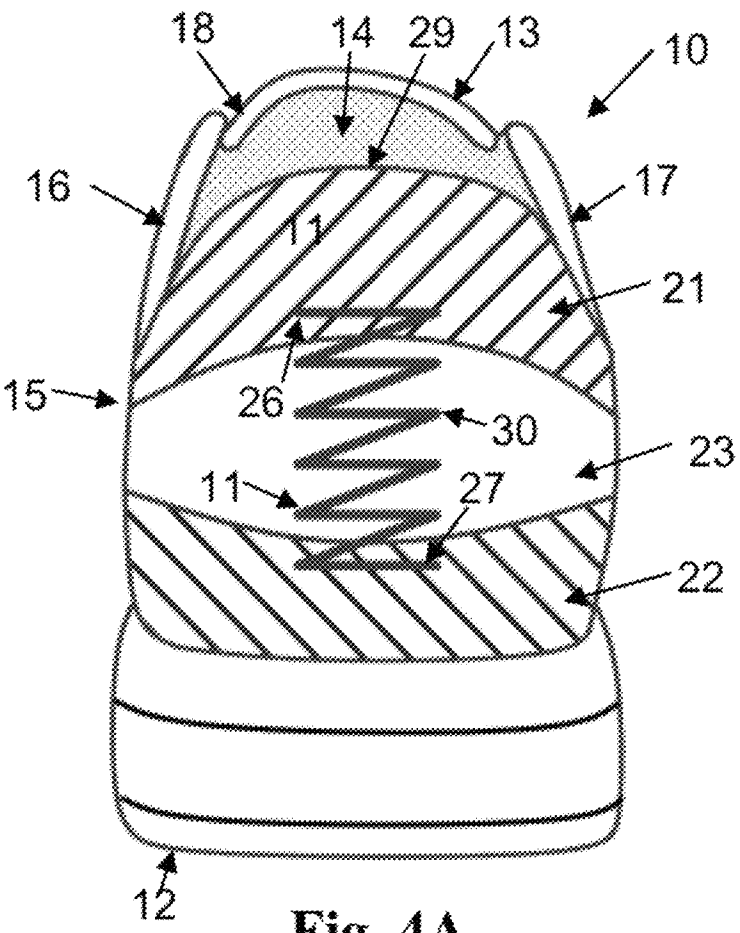
FIG. 4A is a simplified illustrations of a rear view of the interior of rear part of the easy entry footwear, with a sinusoidal compression spring, in uncompressed mode.

Reference is now made to FIG. 4A and FIG. 4B, which are simplified illustrations of a rear view of the interior of rear part 15 of shoe 10 with a sinusoidal compression spring 30, according to one embodiment. FIG. 4A depicts rear part 15 and/or sinusoidal compression spring 30 in uncompressed mode, and FIG. 4B depicts rear part 15 and/or sinusoidal compression spring 30 in a compressed mode.

As an option, the illustrations of FIG. 4A and FIG. 4B may be viewed in the context of the details of the previous Figures. Of course, however, the illustrations of FIG. 4A and FIG. 4B may be viewed in the context of any desired environment. Further, the aforementioned definitions may equally apply to the description below.

As shown in FIG. 4A and FIG. 4B, sinusoidal compression spring 30 is a rear spring 11 shaped as with repetitive form of sharp angles, and/or sharp curves. Any alternative repetitive form is also contemplated, such as a sinusoidal form, whether such form is periodic or aperiodic. As shown in FIG. 4A and FIG. 4B, sinusoidal compression spring 30 may be mounted to contract vertically, and may be shaped in a laterally flat form, and may be mounted inside a sleeve (not shown in FIGS. 4A and 4B), on the interior or exterior surface of the rear part 15 and/or embedded within the rear part 15.

As shown in FIG. 4A and FIG. 4B, sinusoidal compression spring 30 may be attached to top part 21 in area 26, and to bottom part 22 in area 27. Spring 30 may be attached to rear part 15 over (on the outside of) center part 23 or within center part 23. Alternatively, sinusoidal compression spring 30 may be attached to top part 21 in area 26 and to sole 12 (not shown in FIGS. 4A and 4B).

Figure 5A:
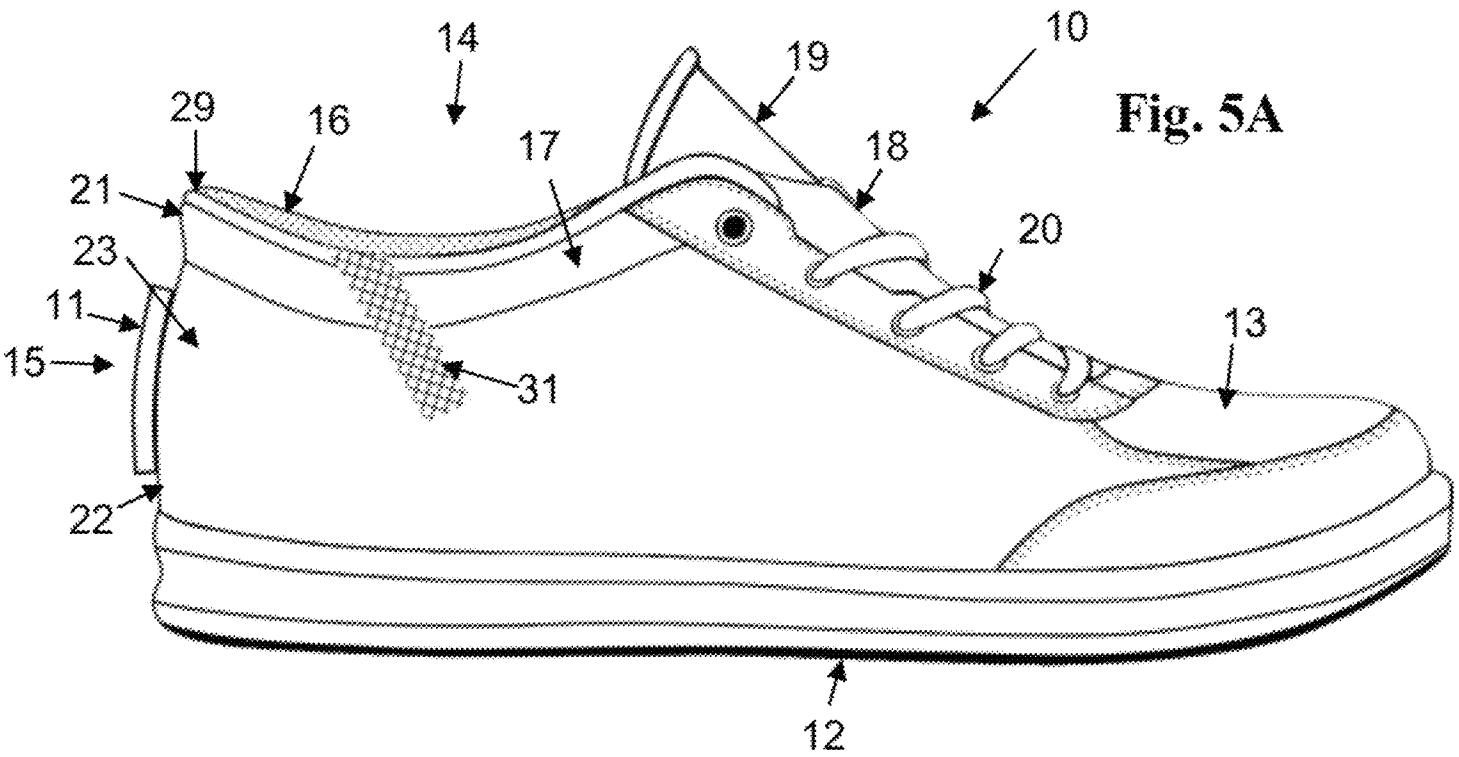
FIG. 5A is a simplified illustration of a side view of the easy entry footwear with rear part in an uncompressed position, and with an elastic element in an unstretched position.
Figure 5B:
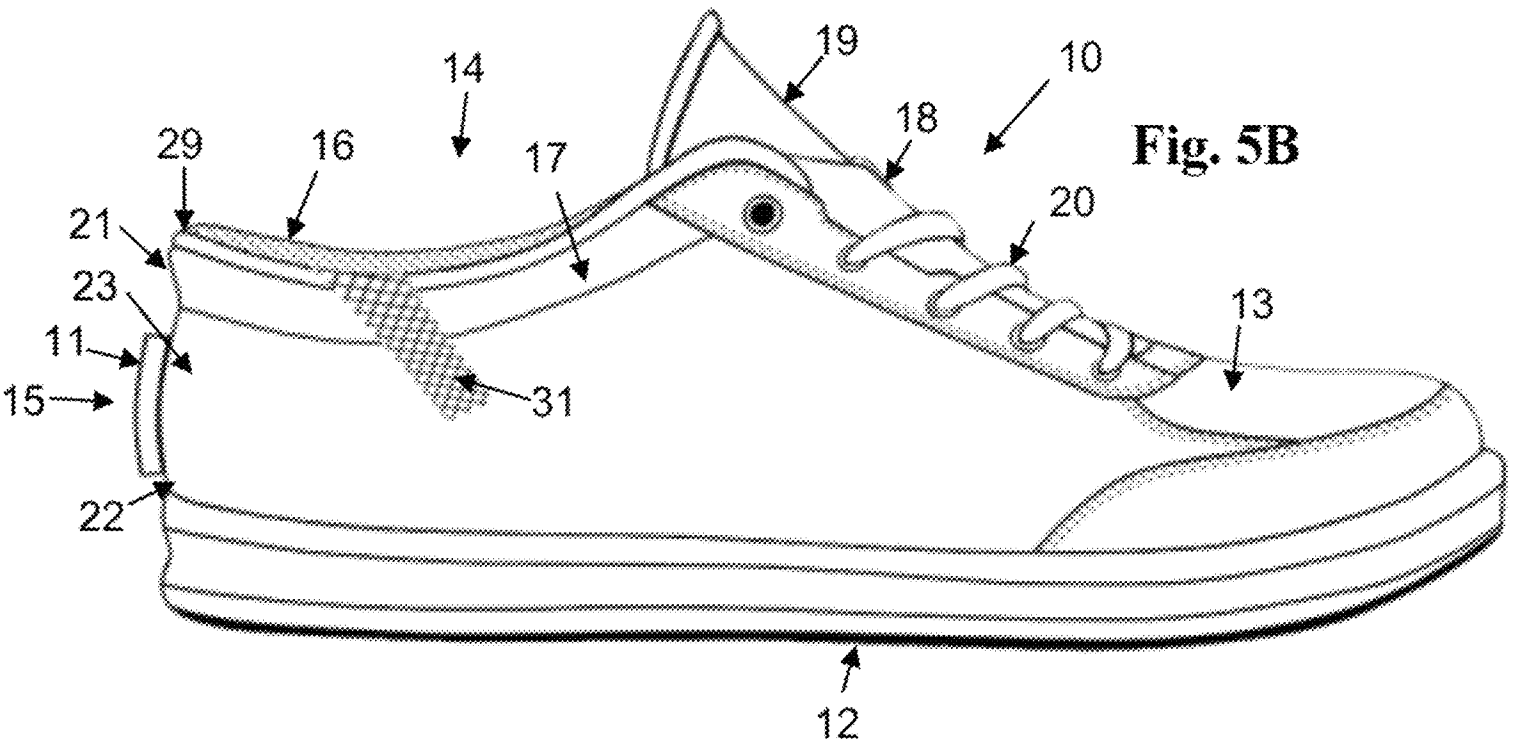
FIG. 5B is a simplified illustration of a side view of the easy entry footwear with rear part in a compressed position, and with an elastic element in a stretched position.

Reference is now made to FIG. 5A, which is a simplified illustration of a side view of shoe 10 with rear part 15 in an uncompressed position, and with an elastic element 31 in an unstretched position, and to FIG. 5B, which is a simplified illustration of a side view of shoe 10 with rear part 15 in a compressed position, and with an elastic element 31 in a stretched position, according to one embodiment.

As an option, the illustrations of FIG. 5A and FIG. 5B may be viewed in the context of the details of the previous figures. Of course, however, the illustrations of FIG. 5A and FIG. 5B may be viewed in the context of any desired environment. Further, the aforementioned definitions may equally apply to the description below.

As shown in FIG. 5A, at least one part of shoe opening 14, such as, for example, elastic element 31, may be made of elastic material, such as a rubber strap as a non-limiting example. Elastic element 31 is shown in FIG. 5A and FIG. 5B as part of lateral part 17, however, elastic element 31 may be alternatively mounted as part of medial part 16, or alternatively, as part of both medial part 16 and lateral part 17.

When the foot enters the shoe the elastic material of elastic element 31 stretches, thus enabling top portion 21 of rear part 15 to move down, and at the same time, allows shoe opening 14 to expand, providing enough space for the foot to go through the shoe opening. The elastic material may be allowed to contract once the foot enters the shoe, keeping the foot secured inside the shoe.

It is appreciated that rear spring 11, as described above or of any other shape and form, may be adapted to the shape of rear part 15. In this respect, rear spring 11 may be curved vertically, upwards and forward, according to the curvature of rear part 15. In this respect, rear spring 11 may be curved horizontally according to the curvature of rear part 15.

While the described embodiments have only presented a single rear spring 11 located in the rear part 15 of a shoe, it should be appreciated that in some embodiments, multiple spring elements may be in the rear part 15 and/or the lateral part 17 and/or the medial part 16. Similarly, while some embodiments have been described as utilizing a single elastic element 31 in the lateral part 17 and/or the medial part 16, it should be appreciated that multiple elastic parts 17 may be utilized in the lateral part 17, medial part and/or rear part 15. It should also be appreciated that the elastic part 31 maybe embedded within the interior of the lateral part 17, medial part 16 and/or rear part 15 and a slit or kerf in the lateral part 17, medial part 16 and/or rear part 15 can be forced open by the foot but then drawn back together by the force of the elastic part 31. It should also be appreciated that rather than a separate rear spring 11, the material that the rear part 15, or a portion of the rear part 15 can in and of itself be constructed of an elastic material that can be compress by force but then return to its pre-compressed state upon the removal of the force. For instance, the center part 23 maybe constructed of a material that can be compressed under a force and then rebound to its non-compressed state upon the removal of the force.

It is expected that during the life of this patent various footwear technologies and materials will be developed and the scope of the terms herein, particularly of the terms "footwear", and "shoe", is intended to include all such new technologies and materials a priori.

Additional objects, advantages, and novel features of the embodiments described herein will become apparent to one ordinarily skilled in the art upon examination of the following examples, which are not intended to be limiting. Additionally, each of the various embodiments and aspects of embodiments as delineated hereinabove and as claimed in the claims section below finds experimental support in the following examples.

It is appreciated that certain features of the system and method described herein, which are, for clarity, described in the context of separate embodiments, may also be provided in combination in a single embodiment. Conversely, various features, which are, for brevity, described in the context of a single embodiment, may also be provided separately or in any suitable sub-combination.

Although the system and methods has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art.

What is claimed is:

1. A shoe comprising a sole and a shoe upper, the shoe upper comprising a shoe opening for entering the shoe, the shoe opening defined by a rear part, a medial part, a lateral part, and a front part, wherein the shoe comprises an elastic element in at least one of: the medial part of the shoe, and the lateral part of the shoe, and the rear part comprising:

a top portion, reinforced by a firm material, a bottom portion above the sole, reinforced by a firm material, and a compression spring element comprising:

a top part and a bottom part being configured to be compressed towards each other by the application of a force on the top part, and a side profile that lays flush against the contour of the rear part of the shoe, wherein the compression spring is mounted inside a sleeve or embedded within the rear part, wherein the compression spring is substantially centered between the left side and the right side of the rear part, wherein the top part of the compression spring element is attached to the top portion of the rear part, and the bottom part of the compression spring element is attached to the bottom portion of the rear part.

2. The shoe according to claim 1, wherein the compression spring element is made of at least one of:

a circular compression spring;

a garter compression spring; and a sinusoidal compression spring.

3. The shoe according to claim 1, wherein the compression spring element is at least one of:

curved vertically, upwards, and forward, according to vertical curvature of the rear part; and curved horizontally according to horizontal curvature of the rear part.

4. A method for entering a shoe, comprising the steps of:

providing a shoe comprising a sole and a shoe upper, the shoe upper comprising a shoe opening for entering the shoe, the shoe opening defined by a rear part, a medial part, a lateral part, and a front part, wherein the shoe comprises an elastic element in at least one of: the medial part of the shoe, and the lateral part of the shoe, and the rear part comprising:

a top portion reinforced by a firm material, a bottom portion, above the sole, reinforced by a firm material, and a compression spring element comprising:

a top part and a bottom part configured to be compressed towards each other by the application of a force of the top part, and a side profile that lays flush against the contour of the rear part of the shoe wherein the compression spring is mounted inside a sleeve or embedded within the rear part, wherein the compression spring is substantially centered between the left side and the right side of the rear part, wherein the top part of the compression spring is attached to the top portion of the rear part, and the bottom part of the compression spring element is attached to the bottom portion of the rear part;

exerting a downward force on the top portion of the rear part when an object enters the shoe to push down the top portion of the rear part, and at the same time the elastic element stretches, allowing the shoe opening to expand, and create enough space for the object to enter the shoe; and releasing the downward force on the top portion of the rear part to enable the compression spring element to push the top portion of the rear part up and for the elastic element to contract for securing the object in the shoe.

5. A method for entering a shoe, comprising the steps of:

providing a shoe comprising a sole and a shoe upper, the shoe upper comprising a shoe opening for entering the shoe, the shoe opening defined by a rear part, a medial part, a lateral part, and a front part, wherein the shoe comprises an elastic element in at least one of: the medial part of the shoe, and the lateral part of the shoe, and the rear part comprising:

a top portion reinforced by a firm material, a bottom portion, above the sole, a compression spring element comprising:

a top part and a bottom part and being configured to be compressed by the application of a force on the top part, and a side profile that lays flush against the contour of the rear part of the shoe, wherein the compression spring is mounted inside a sleeve or embedded within the rear part, wherein the compression spring is substantially centered between a left side and right side of the rear part, wherein the top part of the compression spring element is attached to the top portion of the rear part, and the bottom part of the compression spring element is attached to the sole of the shoe;

exerting a downward force on the top portion of the rear part when an object enters the shoe to push down the top portion of the rear part and at the same time the elastic element stretches, allowing the shoe opening to expand, creating enough space for the object to enter the shoe; and releasing the downward force on the top portion of the rear part to enable the compression spring element to push the top portion of the rear part up and for the elastic element to contract for securing the object in the shoe.

* * * * *